US006997003B2

(12) United States Patent
Grabon et al.

(10) Patent No.: US 6,997,003 B2
(45) Date of Patent: Feb. 14, 2006

(54) METHOD TO CONTROL HIGH CONDENSER PRESSURE

(75) Inventors: Michal K. Grabon, Bressolles (FR); Ba-Tung Pham, Chassieu (FR)

(73) Assignee: Carrier Corporation, Syracuse, NY (US)

( * ) Notice: Subject to any disclaimer, the term of this patent is extended or adjusted under 35 U.S.C. 154(b) by 7 days.

(21) Appl. No.: 10/877,400

(22) Filed: Jun. 25, 2004

(65) Prior Publication Data

US 2005/0284165 A1 Dec. 29, 2005

(51) Int. Cl.
*F25B 5/00* (2006.01)
*F25B 49/02* (2006.01)

(52) U.S. Cl. ..... 62/228.3; 62/228.5; 62/DIG. 17

(58) Field of Classification Search ..... 62/228.5, 62/228.1, 228.3, 228.4, 196.1, 196.2, 196.3, 62/196.4, 510, DIG. 17
See application file for complete search history.

(56) References Cited

U.S. PATENT DOCUMENTS

| | | | | |
|---|---|---|---|---|
| 3,668,883 | A * | 6/1972 | Ruff et al. | 62/510 |
| 5,054,294 | A * | 10/1991 | Dudley | 62/228.4 |
| 5,086,624 | A * | 2/1992 | Matsuoka et al. | 62/228.3 |
| 5,150,581 | A * | 9/1992 | Smith | 62/DIG. 17 |
| 6,185,946 | B1 * | 2/2001 | Hartman | 62/228.5 |
| 6,381,971 | B1 * | 5/2002 | Honda | 62/228.3 |

* cited by examiner

*Primary Examiner*—Harry B. Tanner
(74) *Attorney, Agent, or Firm*—Bachman & LaPointe, PC

(57) ABSTRACT

A method for controlling load capacity in an air conditioning unit comprising the steps of initializing a saturated condensing temperature upper bound (SCT_UP), comparing a saturated condensing temperature (SCT) to a maximum condensing temperature threshold (MCT_TH), unloading a single load capacity step, allowing the air conditioning unit to stabilize, and setting the SCT_UP equal to the SCT after the unloading, and increasing the load capacity by one capacity step if increased load capacity is required, the SCT is less than or equal to the MCT_TH, and the SCT<the SCT_UP.

12 Claims, 1 Drawing Sheet

METHOD TO CONTROL HIGH CONDENSER PRESSURE

BACKGROUND OF THE INVENTION (1) Field of the Invention

The invention relates to a method for controlling high condenser pressure in an air conditioning unit.

(2) Description of the Related Art

In most air conditioning unit systems, there is established a high pressure set point. When the internal pressure of the refrigerant within the air conditioning unit exceeds the set point, such a system customarily shuts down. In fact, there is commonly established a fixed high pressure differential threshold. This differential threshold provides a safety buffer so as to prevent the actual pressure and inside of an air conditioning unit from ever reaching the high pressure set point. In such a scenario, when the internal condenser pressure of the air conditioning unit reaches the high pressure set point minus the fixed high pressure differential threshold, the system is shutdown. In addition, as cooling capacity is added to such an air conditioning unit, additional capacity will not be added if the internal pressure within the air conditioning unit is greater than the high pressure set point minus the fixed high pressure differential threshold, even if increasing capacity under such a condition would not cause the pressure in the air conditioning unit to exceed the high pressure set point.

There therefore arises two potential problems when determining the high pressure differential set point. The first arises from the possibility of setting the fixed high pressure differential set point too high. If the fixed high pressure differential set point, equal to the high pressure set point minus a high pressure differential, then it is possible that bringing an additional compressor on line in a situation wherein the current discharge pressure of the system is below the fixed high pressure differential set point will cause the discharge pressure to rise to a point greater than the high pressure set point. In such an instance, the system will be forced to shutdown. Conversely, setting the high pressure differential set point too low may prevent the air conditioning unit system from increasing capacity even though increased capacity loading is both required and possible.

What is therefore needed is a method of setting a fixed high pressure differential set point such that an air conditioning unit is prevented from tripping at high pressure failure when additional capacity is brought on line, and wherein capacity unloading occurs in an efficient manner when the discharge pressure of the air conditioning unit reaches the high pressure set point of the system.

SUMMARY OF THE INVENTION

Accordingly, it is an object of the present invention to provide a method for controlling high condenser pressure in an air conditioning unit.

In accordance with the present invention, a method for controlling load capacity in an air conditioning unit comprises the steps of initializing a saturated condensing temperature upper bound (SCT_UP), comparing a saturated condensing temperature (SCT) to a maximum condensing temperature threshold (MCT_TH), unloading a single load capacity step, allowing the air conditioning unit to stabilize, and setting the SCT_UP equal to the SCT after the unloading, and increasing the load capacity by one capacity step if increased load capacity is required, the SCT is less than or equal to the MCT_TH, and the SCT<the SCT_UP.

The details of one or more embodiments of the invention are set forth in the accompanying drawings and the description below. Other features, objects, and advantages of the invention will be apparent from the description and drawings, and from the claims.

BRIEF DESCRIPTION OF THE DRAWINGS

Like reference numbers and designations in the various drawings indicate like elements.

DETAILED DESCRIPTION

Figure 1:
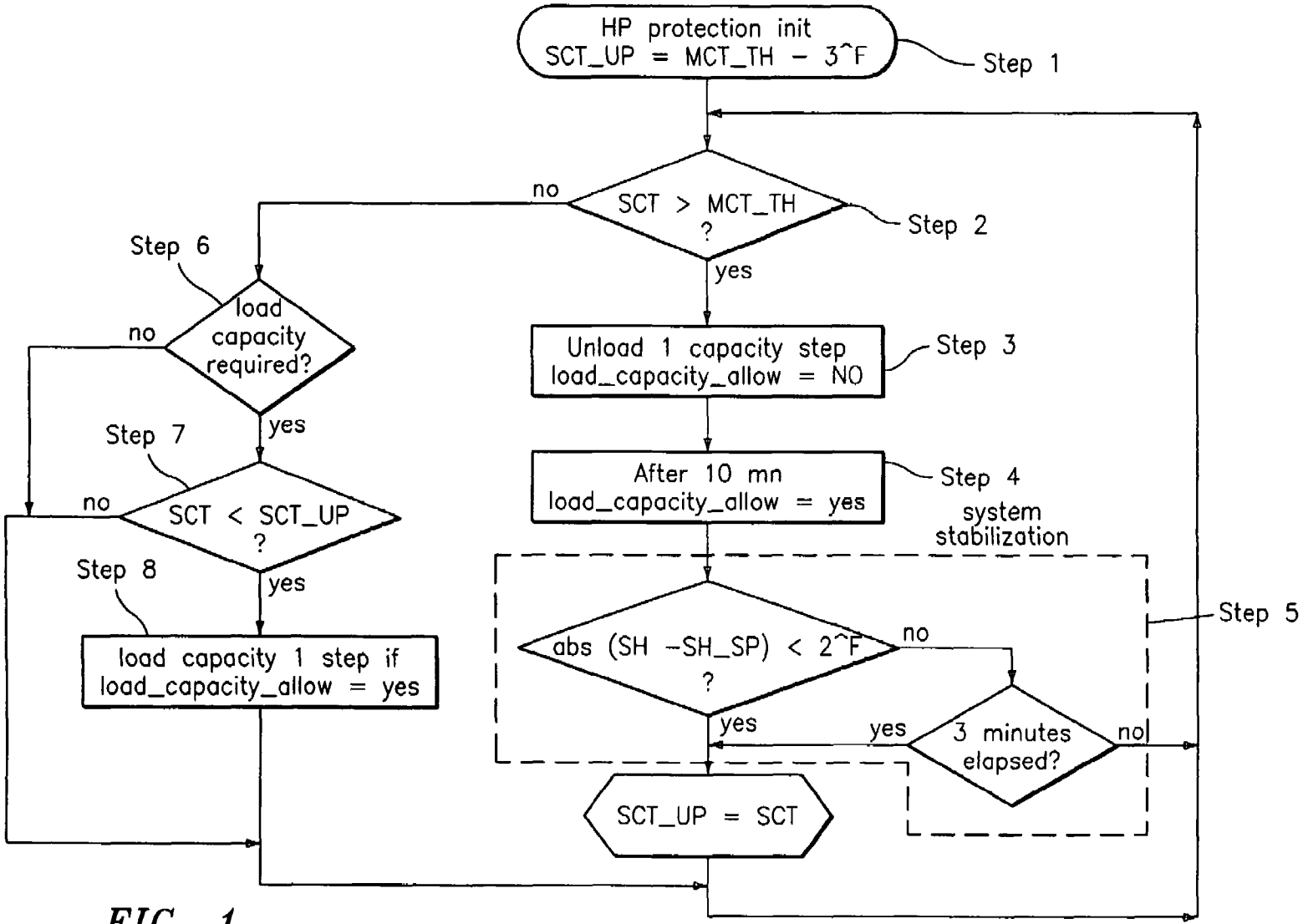
FIG. 1 is a diagram of the logic of the method of the present invention.

It is therefore a teaching of the present invention to provide a method for adding and unloading compressor capacity to an air conditioning unit in response to the operation of the system in accordance with an established high pressure set point. Such a capacity is neither added to the system in a situation which would cause the discharge pressure of the system to exceed the high pressure threshold, nor is the addition of capacity unduly hindered in the situation wherein increasing such a capacity would result in greater efficiency and cooling. As will be described in detail below, these objects of the present invention are achieved by continual monitoring of the discharge pressure of the system in conjunction with establishing a dynamic and intelligent selection of an appropriate high pressure differential set point. If the discharge pressure of the system is greater than the override threshold (i.e., the high pressure threshold), then the capacity of the overall air conditioning unit system is reduced. Once enough capacity has been unloaded, the discharge pressure of the system is stored as an intelligent high pressure differential set point. Capacity unloading is inhibited until the discharge pressure goes below the intelligent high pressure differential set point. In general, the discharge pressure tends to fall below such a set point when the outdoor temperature or suction temperature are decreased.

With reference to FIG. 1, there is illustrated in detail the method of the present invention. While described above with reference to a high pressure threshold set point, a high pressure differential set point, and a discharge pressure, the method of FIG. 1 is described with reference to maximum condensing temperature thresholds (MCT_TH) and saturated condensing temperature (SCT), and the saturated condensing temperature upper bound below which an increase in condenser capacity is allowed (SCT_UP). As is known to one skilled in the art, there is a one-to-one, exact correspondence between the phase change pressure in an air conditioning unit and the phase change temperatures (saturated temperature) of the gas or liquid existing at such pressures. As a result, it is equally apt to describe the method of the present invention with respect to the MCT_TH, which is analogous to the high pressure threshold set point, the SCT_UP which is analogous to the high pressure differential set point, and the saturated condensing temperature (SCT) which is analogous to the discharge pressure of the system. Returning to FIG. 1, step 1 recites the initialization phase of the methodology of the present invention. Specifically, step 1 represents a high pressure protection initialization for the air conditioning unit system. As noted, SCT_UP is analogous to the aforementioned high pressure differential set point and therefore represents the saturated temperature at which it is permissible to increase cooling capacity. Upon initialization, one must derive a value for SCT_UP. SCT_UP is therefore set equal to MCT_TH minus a buffer value. The buffer value is a small value typically between 2° F and 5° F, preferably approximately 3° F, which serves as a buffer between the saturating condensing temperature (SCT) of the air conditioning unit system and the maximum condensing temperature threshold (MCT_TH) so as to prevent the instantaneous SCT of the system from exceeding MCT_TH.

After initialization, a check is performed to see if SCT is greater than MCT_TH. If such is found to be the case, then the saturated condensing temperature of the system is above the maximum condensing temperature threshold of the system and capacity must be unloaded. MCT_TH will vary from air conditioning unit system to air conditioning unit system depending upon the physical constructs comprising the construction of the system under which the system operates, but is in all cases capable of being defined or being measured. If SCT is found to be greater than MCT_TH, capacity is unloaded in a stepwise fashion as illustrated with reference to step 3. As most air conditioning units are comprised of a plurality of compressors operating in parallel, unloading one capacity step corresponds to shutting down or otherwise ceasing the operation of a single compressor. Capacity may be unloaded thusly in a stepwise fashion until all compressors are disabled. It is common practice to restart compressors in a last compressor turned off/first compressor turned on fashion. As illustrated in step 3, once a single compressor is disabled, causing the system to unload one capacity step, a load_capacity_allow status variable, accessible to the air conditioning unit system, is set to NO.

With reference to step 4, it is seen that the load_capacity_allow variable is not set to YES for a finite and predetermined period of time. In step 4, this predefined period of time is illustrated in exemplary fashion as a duration of ten minutes. However, this duration may be chosen to assume any variable value sufficient to prevent the unwanted rapid turning off and turning on of a single compressor over and over again when SCT hovers slightly above and slightly below MCT_TH. By waiting a predetermined period of time before setting the load_capacity_allow variable to YES, there is no chance of load capacity being added, and hence an additional compressor being turned on, until the predetermined period of time has elapsed.

After cooling capacity has been reduced by one step and the load_capacity_allow variable has been set in step 3 and step 4, the air conditioning unit system is allowed to stabilize as illustrated with reference to step 5. When a compressor is unloaded, a period of time must elapse before the temperatures in the system arrive at a semblance of stabilization. Stabilization is defined at the point at which the absolute value of the superheat (SH) minus the superheat set point (SH_SP) is less than the stabilization threshold. As illustrated in step 5, in exemplary fashion, the stabilization threshold is 2° F. The actual stabilization threshold value is chosen such that, when the absolute value (abs) of the difference between SH and SH_SP is less than the stabilization threshold, the operation of the air conditioning unit is stable. When this condition is met, the system is considered to be stable. If the abs (SH—SH_SP) is not less than the stabilization threshold, the system takes no action for a specified stabilization period of time. On average, unloading one capacity step by shutting down a single compressor requires approximately three minutes before the system stabilizes to an appropriate degree. Therefore, step 5 is illustrated with the exemplary value of three minutes as the stabilization period. In actual practice, the stabilization period may assume any value sufficient to insure that the system has reached stabilization prior to proceeding to comparing SCT_UP to SCT. As is illustrated after the system is stabilized, a comparison is performed whereby SCT_UP is set to SCT. As noted above, SCT_UP was initialized without any knowledge of the saturated condensing temperature at which it would be permissible to allow an increase in capacity. After removing one capacity step, and measuring the saturated condensing temperature, SCT, SCT_UP is set equal to SCT. In this manner there is dynamically updated SCT_UP to a value at which it is safe to add load capacity if required. After setting SCT_UP equal to SCT, step 2 is repeated. In the instance that SCT is still greater than MCT_TH, steps 3, 4, and 5 are repeated and an additional capacity step is unloaded and the system is allowed to stabilize again.

In the event that SCT is not greater than MCT_TH, load capacity may be required as well as being possible. If SCT is not greater than MCT_TH, step 6 is performed. Specifically, in step 6, a determination is made whether load capacity is required. That is to say is the temperature of the water leaving from the cooler of the air conditioning unit greater than the temperature set point. The temperature set point is the desired temperature for the space being cooled by the air conditioning unit. If load capacity is required, step 7 is performed to determine if it is possible to increase capacity by one step without exceeding MCT_TH.

With reference to step 7, it can be seen that SCT is compared to SCT_UP. If SCT is less than SCT_UP, then it is possible to increase load capacity by one step if and only if load_capacity_allow is set to YES. This is illustrated with reference to step 8. If SCT is equal to or greater than SCT_UP, it is not possible to increase load capacity by one step without potentially exceeding MCT_TH and therefore no action is taken and the method of the present invention returns to step 2 and continues.

One or more embodiments of the present invention have been described. Nevertheless, it will be understood that various modifications may be made without departing from the spirit and scope of the invention. Accordingly, other embodiments are within the scope of the following claims.

What is claimed is:

1. A method for controlling load capacity in an air conditioning unit comprising the steps of:

initializing a saturated condensing temperature upper bound (SCT_UP);

comparing a saturated condensing temperature (SCT) to a maximum condensing temperature threshold (MCT_TH);

unloading a single load capacity step, allowing said air conditioning unit to stabilize, and setting said SCT_UP equal to said SCT after said unloading; and increasing said load capacity by one capacity step if increased load capacity is required, said SCT is less than or equal to said MCT_TH, and said SCT<said SCT_UP.

2. The method of claim 1 wherein said initializing step comprises the step of setting said SCT_UP equal to said MCT_UP minus a buffer value.

3. The method of claim 2 wherein said initializing said SCT_UP comprises setting said SCT_UP equal to said MCT_UP minus a buffer value between 2° F and 5° F.

4. The method of claim 3 wherein said initializing said SCT_UP comprises setting said SCT_UP equal to said MCT_UP minus a buffer value of approximately 3° F.

5. The method of claim 1 wherein said unloading said single load capacity step comprises setting a load_capacity_allow variable to NO.

6. The method of claim 5 comprising the additional step of setting said load_capacity_allow variable to YES after a period of time.

7. The method of claim 6 wherein said setting said load_capacity_allow variable to YES after said period of time comprises setting said load_capacity_allow variable to YES after approximately ten minutes.

8. The method of claim 1 wherein said allowing said air conditioning unit to stabilize comprises waiting for a stabilization period.

9. The method of claim 8 wherein said waiting for a stabilization period comprises waiting for approximately three minutes.

10. The method of claim 1 wherein said allowing said air conditioning unit to stabilize comprises establishing stabilization if abs(SH—SH_SP) is less than a stabilization threshold.

11. The method of claim 10 wherein said establishing stabilization comprises establishing stabilization if abs (SH—SH_SP) is less than approzimately 2° F.

12. The method of claim 1 wherein said increasing said load capacity comprises increasing said load capacity if a load_capacity_allow variable is set to YES.

* * * * *